US007328560B2

(12) United States Patent
Martelli

(10) Patent No.: US 7,328,560 B2
(45) Date of Patent: Feb. 12, 2008

(54) APPARATUS FOR PACKAGING PRODUCTS IN BOXES

(75) Inventor: Antonio Martelli, Bologna (IT)

(73) Assignee: O.A.M.-Societa' per Azioni, Pianoro (IT)

( * ) Notice: Subject to any disclaimer, the term of this patent is extended or adjusted under 35 U.S.C. 154(b) by 0 days.

(21) Appl. No.: 11/403,959

(22) Filed: Apr. 14, 2006

(65) Prior Publication Data

US 2006/0243559 A1 Nov. 2, 2006

(30) Foreign Application Priority Data

May 2, 2005 (IT) ..... BO2005A0304

(51) Int. Cl.

| | |
|---|---|
| ***B65B 43/26*** | (2006.01) |
| ***B65B 3/02*** | (2006.01) |
| ***B65B 43/42*** | (2006.01) |
| ***B31B 1/78*** | (2006.01) |
| *B65G 47/26* | (2006.01) |

(52) U.S. Cl. ..... 53/564; 53/458; 53/250; 53/574; 493/318; 198/460.1

(58) Field of Classification Search ..... 53/564, 53/566, 574, 579, 458, 252, 250; 493/318, 493/319, 312; 198/460.1, 464.2
See application file for complete search history.

(56) References Cited

U.S. PATENT DOCUMENTS

| | | | | |
|---|---|---|---|---|
| 3,455,086 | A * | 7/1969 | Bescript et al. | 53/169 |
| 3,574,986 | A | 4/1971 | Dieter | |
| 3,906,705 | A * | 9/1975 | Beck et al. | 53/252 |
| 4,232,591 | A * | 11/1980 | Karpinsky | 493/314 |
| 4,537,587 | A * | 8/1985 | Langen | 493/315 |
| 4,578,927 | A * | 4/1986 | Scarpa et al. | 53/506 |
| 4,614,079 | A * | 9/1986 | Ida et al. | 53/563 |
| 5,014,501 | A * | 5/1991 | Constantin et al. | 53/173 |
| 5,052,544 | A * | 10/1991 | Anderson | 198/456 |
| 5,092,450 | A * | 3/1992 | Schommartz et al. | 198/460.1 |
| 5,185,984 | A * | 2/1993 | Tisma | 53/252 |
| 5,581,981 | A | 12/1996 | Fulkerson et al. | |
| 5,715,657 | A * | 2/1998 | Mondani et al. | 53/457 |

FOREIGN PATENT DOCUMENTS

| | | |
|---|---|---|
| DE | 737 489 C | 7/1943 |
| EP | 0 480 533 A | 4/1992 |
| GB | 1 269 377 A | 4/1972 |

* cited by examiner

*Primary Examiner*—Rinaldi I. Rada
*Assistant Examiner*—Paul Durand
(74) *Attorney, Agent, or Firm*—Modiano & Associati; Albert Josif; Daniel J. O'Byrne

(57) ABSTRACT

An apparatus for packaging products in boxes provided with a supporting footing, a box feeding magazine, at least one pick-up device, at least one feeder conveyor of products to be placed in the boxes, at least one rotating carousel for receiving in a plurality of peripheral receptacles that have one open side, from the pick-up device, the boxes in a parallelepipedal configuration, and with axial pusher elements. The feeder conveyor has a loop element provided with supporting cups for the products to be placed in boxes.

15 Claims, 3 Drawing Sheets

APPARATUS FOR PACKAGING PRODUCTS IN BOXES

The present invention relates to an apparatus for packaging products in boxes.

BACKGROUND OF THE INVENTION

Many types of machine suitable to package various products in boxes are commercially available; such boxes are of the substantially parallelepipedal type and are fed in a mutually packed and flattened configuration.

Some commercially available machines are provided with at least one rotating drum, which has a horizontal axis and is provided with a plurality of peripheral receptacles which are adapted to receive the boxes in the open configuration and to convey them continuously toward subsequent production stations after the boxes have been filled with the products to be packaged by way of the action of appropriately provided pushers. For this purpose, in conventional apparatuses there are a plurality of supporting cups which are mounted on the drum and support the products to be inserted in the boxes, each one of said cups being arranged at a respective peripheral receptacle.

Upstream of the rotating drum, the products to be packaged are usually deposited in the supporting cups by means of an appropriately provided feeder, which is constituted for example by a belt (or a chain) which is closed in a loop and is provided on its surface with conveyance teeth, which convey the products.

However, modem market requirements, aimed at constantly increasing production rates (i.e., the number of products manufactured in one minute of work of the machine) reveal some limitations of known apparatuses. In particular, it has been noted in practical operation that the transfer of the products to be packaged from the feeder belt to the cups rigidly coupled to the rotating drum is a critical point, since the execution of this transfer prevents achieving high production rates: this might in fact produce the occurrence of malfunctions and jamming in the feeding of such products.

SUMMARY OF THE INVENTION

The aim of the present invention is to obviate the drawback described above, by providing an apparatus for packaging products in boxes which is mainly adapted to operate at production rates which have not yet been achieved with machines of the conventional type.

Within this aim, an object of the present invention is to provide an apparatus for packaging products in boxes which is safe and reliable in operation even at relatively high production rates.

Another object of the present invention is to provide an apparatus which is simple, relatively easy to provide in practice, safe in use, effective in operation, and has a relatively low cost.

This aim and these and other objects which will become better apparent hereinafter are achieved by an apparatus for packaging products in boxes, of the type which comprises a supporting footing, a magazine for the continuous feeding of boxes in a flattened configuration, at least one device for picking up the boxes from said magazine and for opening said boxes in a substantially parallelepipedal configuration, at least one feeder of products to be placed in the boxes and at least one rotating carousel which is adapted to receive the boxes, in a parallelepipedal configuration, from said pick-up and opening device in a plurality of peripheral receptacles, each of which has at least one open side, said carousel being further provided with axial pusher means, which are suitable to insert the products in the respective boxes through said open sides, and being further suitable to convey the boxes filled with the products toward subsequent production stations, said apparatus being characterized in that said feeder comprises at least one feeder conveyor, which is closed in a loop and is provided, on its external surface, with a uniform distribution of supporting cups, which are adapted to convey the products to be placed in boxes from at least one hopper to said rotating carousel, said feeder conveyor being associated with actuation means which are suitable to produce the advancement of said cups with the products to be placed in boxes in step with the rotation of said rotating carousel, so as to allow their insertion, one by one, in the respective boxes by way of said axial pusher means.

BRIEF DESCRIPTION OF THE DRAWINGS

Further characteristics and advantages of the invention will become better apparent from the following detailed description of a preferred but not exclusive embodiment of an apparatus for packaging products in boxes according to the invention, illustrated by way of non-limiting example in the accompanying drawings, wherein.

In the exemplary embodiment that follows, individual characteristics may actually be interchanged with other different characteristics that exist in other exemplary embodiments.

Moreover, it is noted that anything found to be already known during the patenting process is understood not to be claimed and to be the subject of a disclaimer.

DESCRIPTION OF THE PREFERRED EMBODIMENTS

Figure 1:
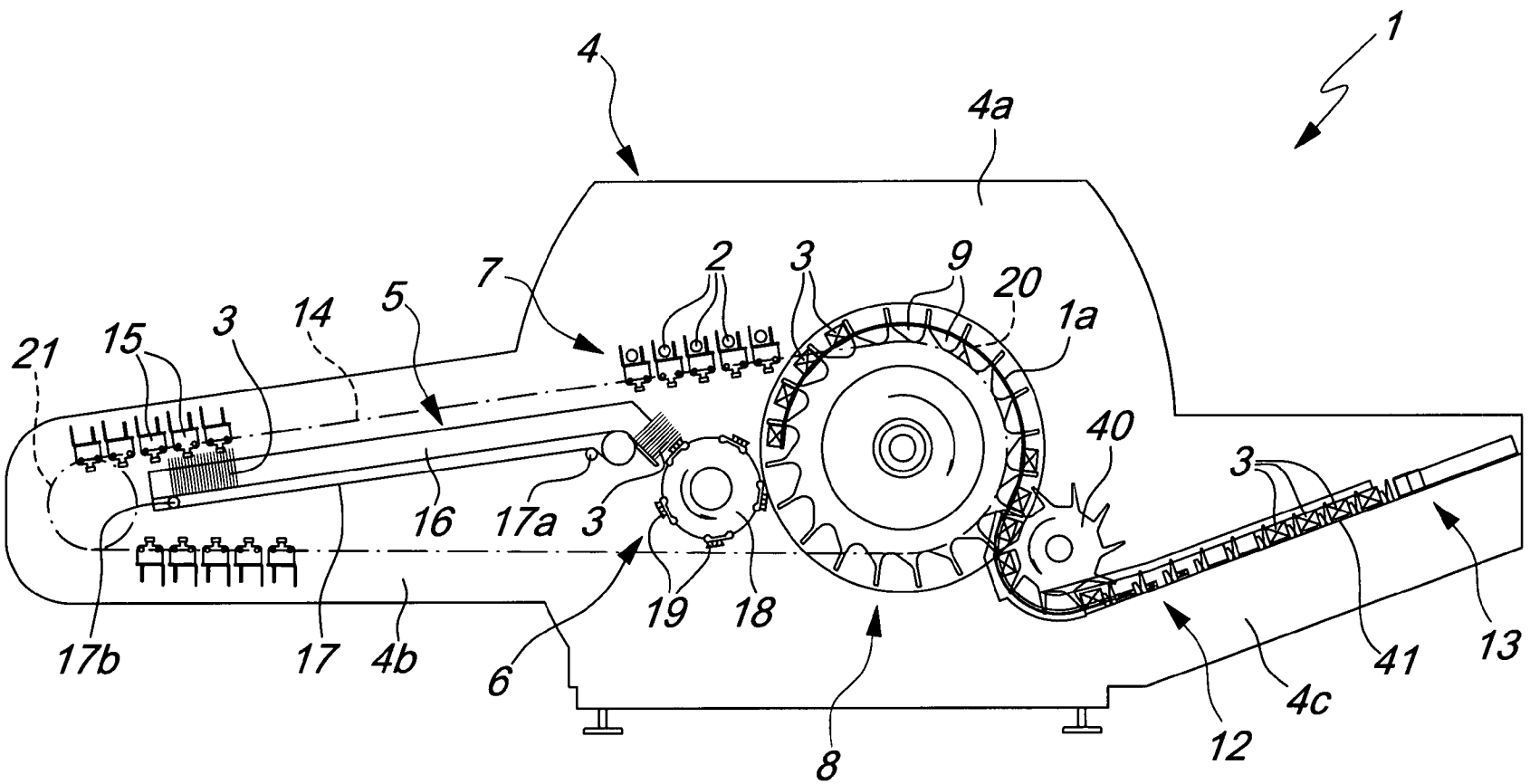
FIG. 1 is a schematic front view of the apparatus according to the invention.

With reference to FIG. 1, the reference numeral 1 generally designates an apparatus for packaging products 2 in boxes 3, according to the invention.

The apparatus 1 is adapted to perform the complete packaging of any type of product 2 in boxes 3 which are substantially parallelepipedal and are preferably but not necessarily made of a material such as cardboard. The apparatus is flexible and versatile in operation and allows to process products 2 (and consequently boxes 3) having the most disparate shapes and dimensions.

Figure 2:
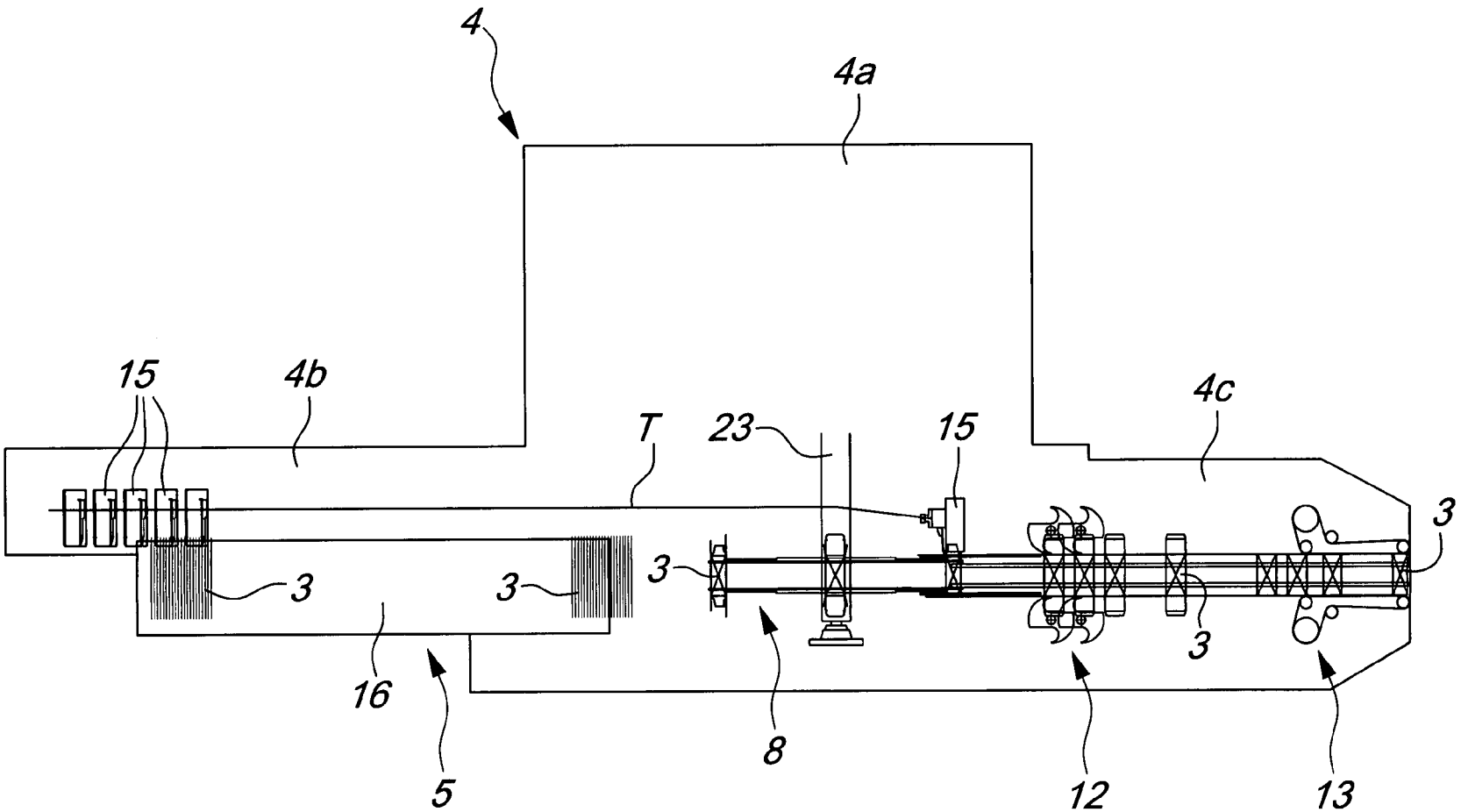
FIG. 2 is a schematic plan view of said apparatus.

As shown in FIGS. 1 and 2, the apparatus 1 comprises a supporting footing, generally designated by the reference numeral 4, which forms a central portion 4*a* and two mutually opposite lateral extensions 4*b*, 4*c*. The apparatus further comprises a magazine, generally designated by the reference numeral 5, for the continuous feeding of boxes 3 in a flattened configuration for minimum space occupation.

The apparatus is also provided with at least one device, generally designated by the reference numeral 6, for picking up the boxes 3 from the magazine 5 and for opening said boxes in a substantially parallelepipedal configuration, and further with at least one feeder conveyor of products 2 to be packaged, generally designated by the reference numeral 7.

The apparatus is provided with a rotating carousel 8, which is adapted to receive the boxes 3, in the open parallelepipedal configuration, from the pick-up and opening device 6 in a plurality of peripheral receptacles 9, each of which has at least one open side, in particular the side 10 directed toward the footing 4 of said apparatus. Each one of the receptacles 9 is provided with respective means for locking the boxes 3, for example of the clamp type; the rotating carousel 8 is provided peripherally with a bottom surface 10*a*, which guides the boxes 3 in a parallelepipedal configuration from when they enter the rotating carousel 8 until they leave it.

Figure 3:
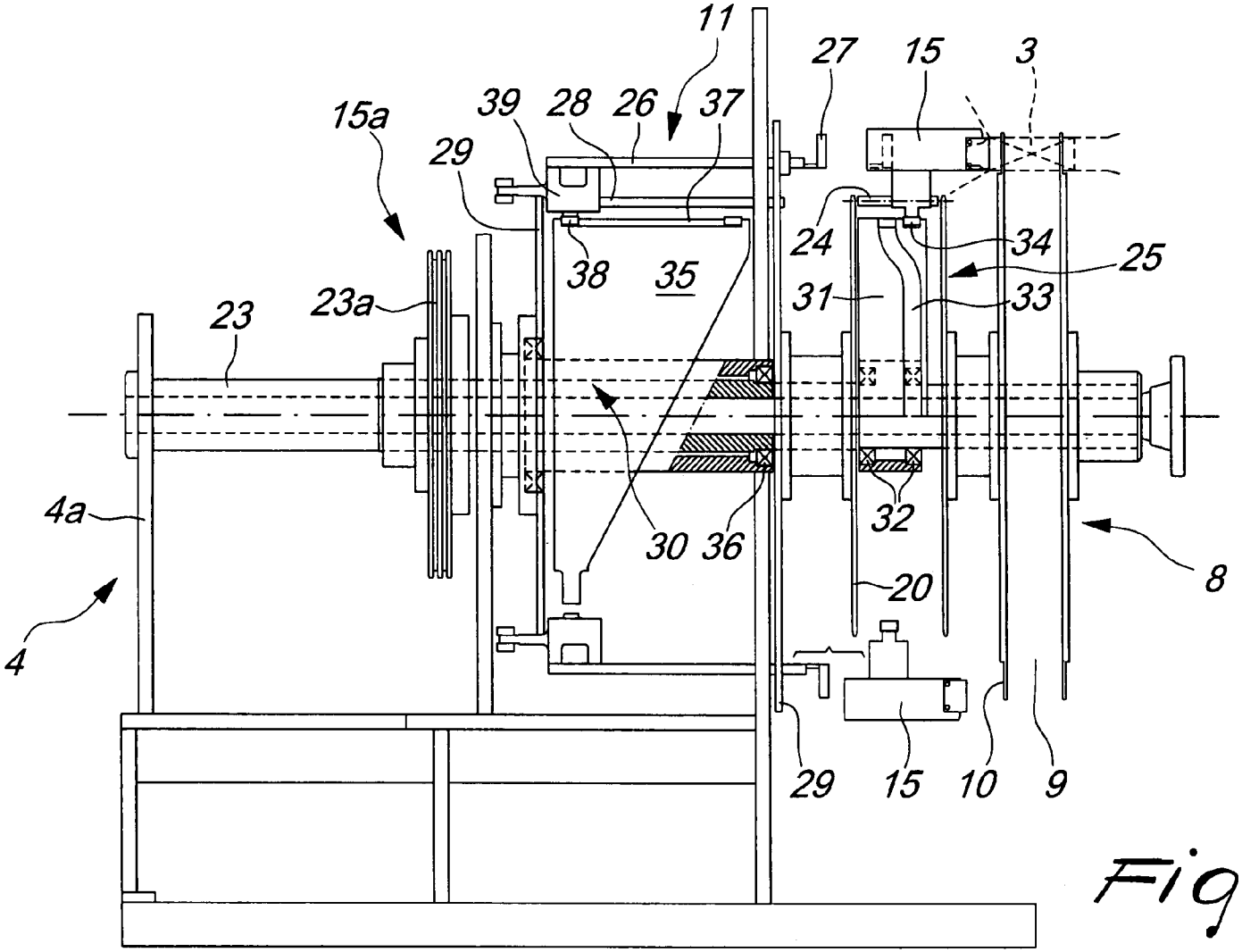
FIG. 3 is a simplified detailed sectional view of the rotating carousel of the apparatus according to the invention.

The rotating carousel 8 is provided with axial pusher means, generally designated by the reference numeral 11 (shown in FIG. 3), which are adapted to insert the products 2 in the respective boxes 3 through the open sides 10, and is further suitable to convey the boxes 3, filled with the products 2, toward subsequent production stations, designated by the reference numerals 12, 13.

According to the invention, the feeder conveyor 7 comprises advantageously at least one loop element 14 which is closed in a loop, and is provided, on its external surface, with a uniform distribution of supporting cups 15, which are adapted to convey the products 2 to be packaged from a known type of feeder, not shown for the sake of simplicity in the figures, which is arranged along the advancement path of the cups 15 toward the rotating carousel 8. The loop element 14 is conveniently associated with actuation means 15*a*, which are suitable to produce the advancement of the cups 15 with the products 2 to be packaged in step with the rotation of the rotating carousel 8, so as to allow their insertion, one by one, in the respective boxes 3 by way of the action of the axial pusher means 11.

The magazine 5 comprises (FIG. 1) an elongated guide 16, which ends substantially radially with respect to the device 6 for picking up and opening the boxes 3 and is associated in a lower region with belt drive means 17 (wound around rollers 17*a*, 17*b*) for the boxes 3, which are packed together in a flattened configuration for minimal space occupation.

The pick-up and opening device 6 conveniently comprises at least one rotating drum 18, which is provided peripherally with sucker grip elements 19, which are mutually angularly equidistant and are actuated, by way of cam means not shown in the figures for the sake of simplicity, so as to grip on one side the boxes 3 in the flattened configuration one by one sequentially from the magazine 5 and deposit them, on the other side and in a substantially parallelepipedal configuration, in the peripheral receptacles 9 of the rotating carousel 8. The sucker grip elements 19 are associated conveniently with respective oscillating opening means, not shown in the figures, which are suitable to act on one of the side walls of the boxes 3 in the flattened configuration, so as to make them assume the parallelepipedal configuration. The oscillating means for opening the boxes 3 are, for example, of the sucker type which adheres to the outer surface of the side wall of the box, or of other functionally equivalent types.

The loop element 14 is constituted advantageously by at least one chain, which is closed in a loop and is wound around at least one driving sprocket 20, which is coaxial to the rotating carousel 8, and at least one driven sprocket 21, which is supported rotatably in the footing 4 (in particular in the lateral extension 4*b*); the loop element 14 conveniently has, on its outer surface 22, the uniform distribution of the cups 15 for the products 2 mentioned earlier. As shown also in FIG. 3, the actuation means 15*a* comprise a shaft 23, which is coaxial and rigidly coupled to the rotating carousel 8 and is provided, at one end, with a terminal gear 23*a* and is supported so that it can rotate in the footing 4 of the apparatus; the driving sprocket 20 of the loop element 14 is keyed rigidly coaxially to the shaft 23, so that it can rotate in step with the rotating carousel 8. The terminal gear 23*a* is in turn associated with the motor drive assembly of the apparatus, which for the sake of simplicity is not shown in the figures but is of a fully traditional type.

Each one of the cups 15 for supporting the products 2 to be packaged is fitted so that it can slide on first guides 24, which are rigidly coupled peripherally to the loop element 14 and are parallel to the axis of the rotating carousel 8. Conveniently, first cam means, generally designated by the reference numeral 25, are provided which are adapted to produce the sequential translational motion of each one of the cups 15 from a first inactive axial position (shown in the lower part of FIG. 3) to a second axial position (shown in the upper part of said FIG. 3), in which each one of the cups 15 is substantially inserted at the open side 10 of the respective peripheral receptacle 9 of the rotating carousel 8, so that the axial pusher means 11 insert each product 2 in the respective box 3.

The axial pusher means 11, also disclosed in U.S. Pat. No. 4,769,971 and EP-0250835, advantageously comprise a plurality of stems 26, provided with respective end tabs 27 which are mounted so that they can slide on second guides 28 which are peripherally rigidly coupled to flat and parallel rings 29, which are keyed rigidly along the shaft 23. The stems 26 are associated or connected with second cam means, generally designated by the reference numeral 30, which are adapted to produce the sequential translational motion of each one of the stems 26 from a first retracted axial position to a second extended axial position (shown in broken lines in FIG. 3), in which each one of the stems 26 pushes a product 2 so as to insert it completely in the respective box 3.

The first cam means 25 conveniently comprise a first annular body 31, which is rigidly coupled to the footing 4, is arranged along the path of the loop element 14 and is keyed along the shaft 23 with the interposition of radial bearings 32; the first annular body 31 is affected by a first peripheral track 33, which has an appropriately preset profile and along which first wheels 34 are retained so as to roll, said wheels being supported rotatably respectively in each one of the cups 15 for supporting the products 2 to be placed in boxes.

The second cam means 30, also disclosed in U.S. Pat. No. 4,769,971 and EP-0250835, comprise a second annular body 35, which is rigidly coupled to the footing 4 and is coaxial to the shaft 23 with the interposition of bearings 36. The second annular body 35 is affected by a second peripheral track 37, which has a preset profile and along which second wheels 38 are retained so as to roll, said wheels being supported rotatably respectively in blocks 39 which are rigidly coupled to each one of the stems 26.

The apparatus further comprises an additional carousel 40, which is adapted to pick up the boxes 3, filled with the products 2, from the peripheral receptacles 9 of the rotating carousel 8 and to convey them onto an output feeder conveyor 41, along which the subsequent production stations 12, 13 are arranged and provide for example the closure of the flaps and sides of the boxes 3.

The operation of the apparatus according to the invention is as follows. With reference to FIG. 1, the products 2 to be packaged, loaded by the feeder, are deposited individually in the cups 15 of the loop element 14, and at the same time the boxes 3 in the flattened configuration are gripped one by one, as they advance along the elongated guide 16, by the pickup and opening device 6. The device 6, which is actuated so as to turn counterclockwise, opens the boxes 3 in a substantially parallelepipedal configuration, subsequently depositing them one by one in the peripheral receptacles 9 of the rotating carousel (which is actuated so as to turn clockwise), where they are locked firmly.

The action of the first cam means 25 (and specifically the rolling of the first wheels 34 along the first peripheral track 33) allows to move gradually, one after the other, the cups 15 toward the peripheral receptacles 9 of the rotating carousel 8, so that they substantially fit at the openings of the boxes 3; with reference to the schematic FIG. 2, each cup 15 traces, in plan view, a path for approaching the rotating carousel 8 which is designated by the reference letter T. Subsequently, and conveniently in step with the first cam means 25, the second cam means 30 are actuated and, by way of the rolling of the second rollers 38 in the second track 37, allow the advancement of the stems 26, which insert one by one the products 2 in the respective boxes 3, which are finally conveyed toward the subsequent production stations 12, 13.

It has thus been shown that the invention achieves the proposed aim and objects.

The invention thus conceived is susceptible of numerous modifications and variations, all of which are within the scope of the appended claims.

All the details may further be replaced with other technically equivalent ones.

The embodiment of the present invention shall be carried out in the most scrupulous compliance with the statutory and regulatory provisions related to the products of the invention or correlated thereto and following any required authorization of the corresponding competent authorities, with particular reference to regulations related to safety, environmental pollution and health.

In practice, the materials used, as well as the shapes and the dimensions, may be any according to requirements without thereby abandoning the scope of the protection of the appended claims.

The disclosures in Italian Patent Application No. BO2005A000304 from which this application claims priority are incorporated herein by reference.

What is claimed is:

1. An apparatus for packaging products in boxes, comprising: a supporting footing; a magazine for a continuous feeding of boxes in a flattened configuration; at least one pick-up and opening device for picking up the boxes from said magazine and for opening said boxes in a substantially parallelepipedal configuration; at least one feeder conveyor for feeding products to be placed in the boxes; at least one rotating carousel having a plurality of peripheral receptacles each of which has at least one open side, and which is adapted to receive the boxes, in a parallelepipedal configuration, from said pick-up and opening device in said plurality of peripheral receptacles, said at least one rotating carousel being further provided with axial pusher means, which are suitable to insert the products in the respective boxes through said open sides of said receptacles, and being further suitable to convey the boxes filled with the products toward subsequent production stations, and wherein said at least one feeder conveyor comprises at least one loop element, which is closed in a loop and is provided, on an external surface thereof, with a uniform distribution of supporting cups, said supporting cups being adapted to convey the products to be placed in boxes from the at least one feeder conveyor to said at least one rotating carousel, said loop element being provided with actuation means which are suitable to produce advancement of said supporting cups with the products to be placed in boxes in step with rotation of said at least one rotating carousel, so as to allow insertion of the products, one by one, in the respective boxes by action of said axial pusher means; first guides which are peripherally rigidly coupled to said loop element and are parallel to an axis of symmetry of said at least one rotating carousel; first cam means which are suitable to provide sequential translational motion of each one of said cups from a first inactive axial position to a second axial position, in which each one of said cups is fitted substantially at said open side of the respective peripheral receptacle of said at least one rotating carousel, so as to insert the product in the box by way of said axial pusher means, each one of said cups for supporting the products to be packaged being mounted slidingly on said first guides.

2. The apparatus of claim 1, comprising at least one driving sprocket which is coaxial with respect to said rotating carousel and at least one driven sprocket which is supported for rotation in said supporting footing, said loop element being constituted by at least one closed chain, which is wound around said at least one driving sprocket, and said at least one driven sprocket, said chain being provided, on an external surface thereof, with said uniform distribution of cups.

3. The apparatus of claim 1, wherein said magazine comprises belt means, and at least one elongated guide, which ends substantially radially with respect to said pick-up and opening device, which cooperates with said belt means for moving the boxes packed together in a flattened configuration.

4. The apparatus of claim 1, comprising: second guides which are peripherally rigidly coupled to said at least one rotating carousel; second cam means; and said axial pusher means which is provided with a plurality of stems, slidingly mounted on said second guides and associated with said second cam means, which are adapted to produce a sequential translational motion of each one of said stems from a first retracted axial position to a second extended axial position, in which each one of said stems pushes against the respective product so as to insert it in the box.

5. The apparatus of claim 4, comprising first wheels supported so as to be rotatable, respectively, in each one of said supporting cups for supporting the products to be packaged, said first cam means comprising at least one first annular body, which is rigidly coupled to said supporting footing, is arranged along a path of said loop element and is provided with at least one first peripheral track, which has a preset profile and along which said first wheels are retained so as to roll.

6. The apparatus of claim 5, comprising at least one second peripheral track which has a preset profile; and second wheels being supported so that they can rotate respectively in each one of said stems, said second cam means comprising at least one second annular body, which is coaxial to said rotating carousel and is rigidly coupled to said footing and is provided with at least one second peripheral track, along which said second wheels are retained for rolling thereon.

7. An apparatus for packaging products in boxes, comprising: a supporting footing; a magazine for a continuous feeding of boxes in a flattened configuration; at least one pick-up and opening device for picking up the boxes from said magazine and for opening said boxes in a substantially parallelepipedal configuration; at least one feeder conveyor for feeding products to be placed in the boxes; at least one rotating carousel having a plurality of peripheral receptacles each of which has at least one open side, and which is adapted to receive the boxes, in a parallelepipedal configuration, from said pick-up and opening device in said plurality of peripheral receptacles, said at least one rotating carousel being further provided with axial pusher means, which are suitable to insert the products in the respective boxes through said open sides of said receptacles, and being further suitable to convey the boxes filled with the products toward subsequent production stations; at least one driving sprocket which is mounted on said footing coaxial with respect to said rotating carousel; and at least one driven sprocket which is supported for rotation in said supporting footing and wherein said at least one feeder conveyor comprises at least one loop element, which is closed in a loop and is provided, on an external surface thereof, with a uniform distribution of supporting cups, said at least one loop element being constituted by at least one closed chain, which is wound around said at least one driving sprocket and said at least one driven sprocket, said chain being provided, on an external surface thereof, with said uniform distribution of supporting cups, said supporting cups being adapted to convey the products to be placed in boxes from the at least one feeder conveyor to said at least one rotating carousel, said loop element being provided with actuation means which are suitable to produce advancement of said supporting cups with the products to be placed in boxes in step with rotation of said at least one rotating carousel, so as to allow insertion of the products, one by one, in the respective boxes by action of said axial pusher means.

8. The apparatus of claim 7, wherein said magazine comprises belt means, and at least one elongated guide, which ends substantially radially with respect to said pick-up and opening device, which cooperates with said belt means for moving the boxes packed together in a flattened configuration.

9. The apparatus of claim 7, wherein said driving sprocket is keyed rigidly and coaxially to an actuation shaft of said rotating carousel.

10. The apparatus of claim 7, comprising: first guides which are peripherally rigidly coupled to said loop element and are parallel to an axis of symmetry of said rotating carousel; first cam means which are suitable to provide sequential translational motion of each one of said supporting cups from a first inactive axial position to a second axial position, in which each one of said supporting cups is fitted substantially at said open side of the respective peripheral receptacle of said rotating carousel, so as to insert the product in the box by way of said axial pusher means, each one of said supporting cups for supporting the products to be packaged being mounted slidingly on said first guides.

11. The apparatus of claim 10, comprising: second guides which are peripherally rigidly coupled to said rotating carousel; second cam means; and said axial pusher means which is provided with a plurality of stems, slidingly mounted on said second guides and associated with said second cam means, which are adapted to produce a sequential translational motion of each one of said stems from a first retracted axial position to a second extended axial position, in which each one of said stems pushes against the respective product so as to insert it in the box.

12. The apparatus of claim 11, comprising first wheels supported so as to be rotatable, respectively, in each one of said supporting cups for supporting the products to be packaged, said first cam means comprising at least one first annular body, which is rigidly coupled to said supporting footing, is arranged along a path of said loop element and is provided with at least one first peripheral track, which has a preset profile and along which said first wheels are retained so as to roll.

13. The apparatus of claim 12, comprising at least one second peripheral track which has a preset profile; and second wheels being supported so that they can rotate respectively in each one of said stems, said second cam means comprising at least one second annular body, which is coaxial to said rotating carousel and is rigidly coupled to said footing and is provided with at least one second peripheral track, along which said second wheels are retained for rolling thereon.

14. An apparatus for packaging products in boxes, comprising: a supporting footing; a magazine for a continuous feeding of boxes in a flattened configuration; at least one pick-up and opening device for picking up the boxes from said magazine and for opening said boxes in a substantially parallelepipedal configuration; at least one feeder conveyor for feeding products to be placed in the boxes; at least one rotating carousel having a plurality of peripheral receptacles each of which has at least one open side, and which is adapted to receive the boxes, in a parallelepipedal configuration, from said pick-up and opening device in said plurality of peripheral receptacles, said at least one rotating carousel being further provided with axial pusher means, which are suitable to insert the products in the respective boxes through said open sides of said receptacles, and being further suitable to convey the boxes filled with the products toward subsequent production stations; at least one driving sprocket which is keyed rigidly and coaxially to an actuation shaft of said at least one rotating carousel mounted on said supporting footing; and at least one driven sprocket which is supported for rotation in said footing; and wherein said at least one feeder conveyor comprises at least one loop element, which is closed in a loop and is provided, on an external surface thereof, with a uniform distribution of supporting cups, said at least one loop clement being constituted by at least one closed chain, which is wound around said at least one driving sprocket and said at least one driven sprocket, said at least one chain being provided, on an external surface thereof, with said uniform distribution of supporting cups, said supporting cups being adapted to convey the products to be placed in boxes from the at least one feeder conveyor to said at least one rotating carousel, said loop element being provided with actuation means which are suitable to produce advancement of said supporting cups with the products to be placed in boxes in step with rotation of said at least one rotating carousel, so as to allow insertion of the products, one by one; in the respective boxes by action of said axial pusher means.

15. The apparatus of claim 14, wherein said actuation means comprise the actuation shaft of said at least one rotating carousel.

* * * * *